US005148140A

United States Patent [19]

Goldstein

[11] Patent Number: 5,148,140

[45] Date of Patent: Sep. 15, 1992

[54] ELECTRICAL FUSES HAVING IMPROVED SHORT-CIRCUIT INTERRUPTIONS CHARACTERISTICS

[75] Inventor: Michel Goldstein, Randolph Township, N.J.

[73] Assignee: Brush Fuses, Inc., Des Plaines, Ill.

[21] Appl. No.: 515,211

[22] Filed: Apr. 27, 1990

[51] Int. Cl.[5] ..... H01H 85/04; H01H 85/18

[52] U.S. Cl. ..... 337/158; 337/273; 337/280

[58] Field of Search ..... 337/158, 159, 160, 161, 337/162, 280, 273, 276, 277, 290, 296, 295; 200/151

[56] References Cited

U.S. PATENT DOCUMENTS 4,893,106 1/1990 Goldstein et al. ..... 337/276

*Primary Examiner*—Harold Broome

[57] ABSTRACT

The disclosed electrical fuse has a fuse link in a filling of sand and a binder that imparts high thermal conductivity to the filler. The binder is a shiny coating on the grains of sand extending from grain to grain. It is an amorphous coating. The exemplary binder is boric oxide, $B_2O_3$.

20 Claims, 1 Drawing Sheet

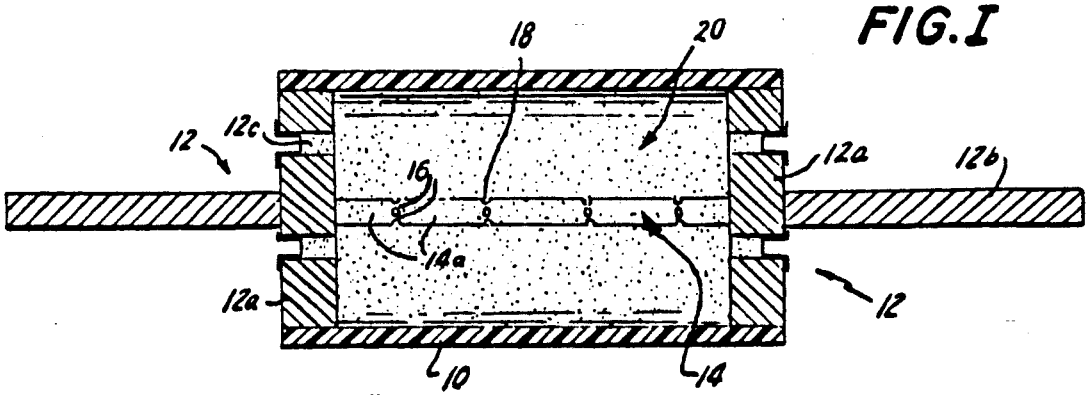
FIG. I
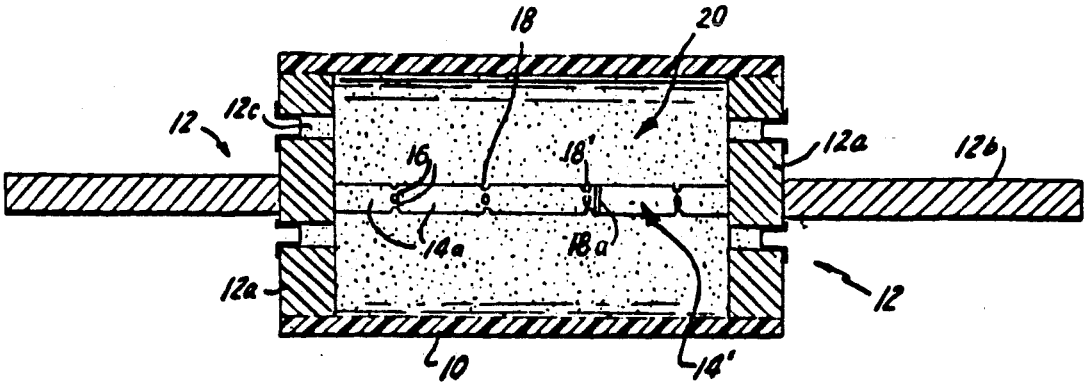
FIG. II

ELECTRICAL FUSES HAVING IMPROVED SHORT-CIRCUIT INTERRUPTIONS CHARACTERISTICS

The present invention relates to electrical fuses.

A widely used type of fuse has multiple short-circuit interruption segments in series between the fuse terminals; a filler of sand or equivalent granular arc-quenching material is packed around the link; and an insulating enclosure contains the arc-quenching material. The fuse link may take many forms, most commonly comprising an element or multiple parallel-connected elements. Each short-circuit segment of a fuse element is a local reduction in cross-section of the element, forming a neck or multiple parallel necks. Current flowing along the link develops resistance heating in each neck. For normal values of current, that heat developed in each neck is conducted away from the neck to the relatively massive adjoining portions of the element; and the heat is dissipated in part by conduction from the element to the end terminals and, in part, by conduction through the granular arc-quenching material to the enclosure and to the end terminals.

When a short-circuit occurs, the necks melt, a gap is formed, and arcing occurs. Many factors affect the fusion of the necks and the extinction of the subsequently formed arcs. It has been considered that an arcing chamber develops in the filler at each arc and that there is a rapid rise of plasma pressure in each arcing chamber which tends to quench the arc. The filler in those fuses has been improved by incorporating a binder of sodium or potassium silicate that unifies the grains of packed sand. The sand with its silicate binder tends to form a confining arc chamber at each arc, thereby promoting a rapid rise of arc-quenching plasma pressure.

U.S. Pat. No. 4,893,106, which issued Jan. 9, 1990 to the present applicant and others as joint inventors, discloses two forms of full-range electrical fuses. In the preferred form, there is a fuse link having multiple serially connected segments in sand having a silicate binder for providing short-circuit protection plus an overload interruption segment; voids in the silicated sand contain boric acid that enhances clearing of overload fault currents.

The '106 patent also discloses the use of boric acid without the silicate binder. Tests reported there (Col. 9) show that boric acid in the packed sand imparts improved short-circuit performance as compared to the short-circuit performance of a fuse having only packed sand as the arc-quenching material. However, the short-circuit interruption performance imparted by the sand-and-boric acid filler is inferior to that property of fuses having silicated sand containing boric acid.

The present invention provides marked improvement in short-circuit interrupting characteristics of fuses. It is useful both in short-circuit interrupting fuses and in full-range fuses. In each of the illustrative fuses described in detail below there is a link formed with multiple serially connected short-circuit interruption segments in a filler; the filler includes sand and a binder that coats the grains of sand and extends from grain-to-grain forming an extremely hard mass. The binder, as seen under a microscope, is a shiny coating. An exemplary binder used in the illustrative fuse is boric oxide, $B_2O_3$, which has high resistivity and other properties advantageous in fuses. The boric oxide is produced in situ, as an amorphous coating on the grains of sand, extending continuously from grain-to-grain.

Measurements show that the novel arc-quenching sand/boric oxide binder has considerably increased thermal conductivity, as compared to silicated sand in an otherwise identical fuse. A number of important advantages result from the improved thermal conductivity of the novel arc-quenching mass, compared to fuses having a filler of silicated sand. The necks of fuse links in fuses having the novel filler can be designed to interrupt a short-circuit much faster, having reduced $I^2t$. Using the novel sand/boric oxide filler, the entire fuse can be much smaller for a given rating—hence much lower in cost—than a like rated fuse having silicated sand as the arc-quenching material. The novel arc-quenching material also makes it more practical to use copper links in place of much more expensive silver links. Additionally, the superior cooling of the fuse link by sand/boric oxide filler reduces metal fatigue of the fuse link when subjected to repeated current surges, thus making the fuses more reliable.

The novel filler makes possible a substantial reduction in heat developed in fuses incidental to their operation, so that a corresponding operating cost saving can be realized reflecting the savings of electrical energy consumed in fuses. Moreover, the invention amelionates concern about dissipating heat developed in fuses that are contained in fuse holders or in switchgear.

The nature of the invention including its further novel aspects and advantages may be more fully appreciated from the following detailed description, read in conjunction with the accompanying drawings.

In the drawings:

FIG. I is a longitudinal cross-section of a high-voltage fuse, including a diagrammatically shown fuse link; and FIG. II is a corresponding view of a modification.

An illustrative fuse shown in FIG. I includes a tube 10 of insulation which serves as an enclosure that has opposite-end metal discs 12*a*. Each disc 12*a* and a corresponding blade 12*b* constitutes a terminal 12, providing terminals at the opposite ends of the fuse. Each disc has ports 12*c* for use in filling the enclosure with sand and in other processing steps to be described. These ports are capped (as shown) when manufacture is completed. Link 14 as of copper or silver forms a fusible connection from one disc 12*a* to the other.

As is typical in one style of fuses, link 14 has a succession of short-circuit interruption segments 18 connected in series as portions of the link. A typical form of short-circuit interruption segment 18 of the link comprises a neck or (as shown) multiple necks 16 in parallel between adjoining portions 14*a* of the link.

Link 14 in the fuse is diagrammatically represented as a single strip or fuse element. For very low values of rated current, a single element may be appropriate (although a smaller-diameter enclosure would be used). For fuses of higher current ratings, it is common to connect many identical fuse elements like that shown, in parallel between discs 12*a*. Cylindrical fuse elements like those in U.S. Pat. No. 4,893,106 can be used. Fuse link 14 diagrammatically represents any desired form of fusible element or assembly of fusible elements.

A filler 20 fills the enclosure and is packed around and against fuse link 14. This filler consists of sand such as is used in many forms of fuses; the grains of sand as well as the surfaces of the fuse link are covered with boron oxide ($B_2O_3$) formed in situ in the following manner or in alternative ways.

The fuse as shown in FIG. I, apart from filler 20, is assembled in the structural form shown, leaving ports 12c open. Sand is introduced via ports 12c until it is packed against link 14 and fills the enclosure. As is customary, the fuse is vibrated as the sand is being introduced, to induce the sand to flow and to ensure thorough filling of all internal spaces with sand. Retaining caps may be inserted in ports 12c to prevent the sand from escaping, but such caps should allow easy entry and escape of fluids involved in the following procedure, being a presently preferred method.

An aqueous solution of boric acid saturated at 105° C., is heated in a vessel. The fuse as described above is heated above 105° C., for example to 120° C., and immersed in the boric acid solution. (If the fuse were cooler than the boric acid solution, it should be expected to drive some boric acid out of solution.) The solution enters the fuse, filling all voids.

The fuse is then frozen. This step drives water out of the solution in the fuse; and then the water is extracted by a flow of drying air through the fuse or by using vacuum, in a "freeze-dry" treatment. Boric acid in the form of flakes is distributed in the voids between the grains of packed sand throughout the fuse at this time.

Finally, the fuse is heated to a uniform temperature of 200° C. This is safely above the temperature—194° C.—at which the boric acid becomes boric oxide, $B_2O_3$. Initially, there are flakes of boric acid in the voids between grains of sand. Those flakes disappear and it can be seen by microscopic inspection that a glaze, a shiny coating, forms over the particles of sand that extends from grain to grain and onto the fuse link. This coating is amorphous $B_2O_3$. One result is that the boric oxide coating is a strong binder that unites tee sand grains to each other and to the fuse link.

When the fuse is immersed in the saturated boric acid solution, knowing the percentage of voids between the sand grains and the volume of the fuse components combined, it is readily demonstrated by measurement of the liquid in the container that the boric acid solution thoroughly impregnates the sand. But by the time all of the water of the solution has been extracted and the boric acid flakes become a boric oxide coating, the volume of that coating is only a small percentage of the original voids between the sand grains. The sand with its $B_2O_3$ binder is a porous hard unified filler.

A comparison was made between two fuses that were identical except for one factor: One fuse had a filler of sand and boric oxide, prepared as above, and the other had a filler of sand and a silicate binder. Rated current was passed through both fuses for a protracted period, e.g., several hours. The average temperature of the fuse link was calculated. In the fuse with the sand/silicate filler, the temperature rose to 229° C. In the fuse prepared as above, with the $B_2O_3$ binder, the temperature rose to only 135° C. The difference in temperature rise is attributable in part to the fact that the resistance heating of the necks in the fuse link increases the resistance of the necks which, in turn, increases their temperature. This effect accentuates any temperature difference between the fuses being compared. Where one fuse develops a higher temperature due to a physical difference, the temperature rise of that fuse is accentuated by the increase in resistivity of the fuse link caused by its own temperature rise. But the very fact that the $B_2O_3$-and-sand filler developed a lower temperature than the silicate-and-sand fuse demonstrates the existence of a much greater thermal conductivity of the $B_2O_3$-and-sand filler than the thermal conductivity of a silicated sand filler.

The advantages of the sand-and-boric oxide filler related to its superior thermal conductivity are many. For example, two fuses with identical links were made, one with a 2½-inch diameter tube 10 and having a silicated sand filler, and the other fuse having a 2-inch diameter tube 10 and having a sand/$B_2O_3$ filler. At rated current, maintained for a protracted time, the larger fuse with silicated said dissipated 130 watts, and the other fuse developed only 80 watts. The amount of heat that is developed in a fuse operated at its maximum current continuously is a limiting factor in fuse design. Excessive temperature of the tube 10 causes it to char and results in failure of the fuse. Use of the boric oxide binder makes it practical to produce a fuse of a particular rating much smaller than a fuse of the same rating having a silicated sand filler. The size reduction carries with it a comparably large reduction in total cost of the fuse.

A fuse with the above described sand-and-$B_2O_3$ filler in the construction shown has the further advantage of improved arc interruption. This may be explained on the following basis. When arcing develops at any fused-and-parted neck 16 (FIG. I) a small arc chamber forms. Due to the $B_2O_3$ binder, arcing in the chamber developed higher plasma pressure, this increased pressure tending to suppress the arc. Additionally, the arc which develops fusing temperature at the arc-chamber surface, causes a reaction between the sand and the $B_2O_3$ to take place, yielding borosilicate. This is an endothermic reaction that has a cooling effect, inducing faster quenching of the arc. The resistance of the arc-chamber surface in a fuse having a sand/$B_2O_3$ filler is excellent, being a further factor that contributes to rapid arc extinction. And, whereas sodium silicate and potassium silicate binders develop sodium and potassium ions in the arc chambers, and such ions actively sustain an arc, no such production of ions notably active in sustaining arcs occurs in the arc chambers of fuses having the boric oxide binder as described. These considerations make it feasible to design the fuse links in such a manner that a considerably reduced $I^2t$ develops during interruption of a short-circuit, signifying a fast-acting fuse. Such a fuse is particularly valuable for use in protecting semiconductor devices.

The reduced link temperature that develops during sustained periods of high current in fuses having the sand/$B_2O_3$ filler is also important in industrial fuses. Without considering a dual-element fuse design described below, considering only the structure of FIG. I, the superior heat-dissipating effect of the novel filler improves the delay characteristic of the fuse, because improved cooling renders the fuse less likely to blow in response to a brief harmless current surge. The cooler operation of the fuse link due to the sand/$B_2O_3$ filler also reduces thermal stresses that develop in a fuse link due to repetitive current surges too low or too brief to cause the fuse to blow. Reduction in the thermal stresses avoids metal fatigue in the fuse link, improving the dependability of fuses in service for long periods of time. Still other significant advantages are realized in fuses having the novel filler.

The procedure detailed above for introducing boric acid into the sand filler of a fuse is presently preferred. Variations in that procedure can be adopted. In an alternative procedure, boric acid as a powder is combined with the sand, rather than using an aqueous solution as described above. In a distinctive procedure for this purpose, grains of sand are charged alike electrostatically and particles of boric acid are separately given an electrostatic charge opposite to that of the sand. The charged grains of sand are mixed with the charged boric acid particles. Due to their opposite charge, the boric acid particles virtually coat the individual sand particles. In this condition the sand and boric acid composite is introduced into the fuse, using vibration as usual, to fill the fuse with sand in which boric acid powder is uniformly distributed. It remains only to heat the fuse to 200° C. as before, to develop $B_2O_3$ in situ.

The fuse in FIG. I, made as described above, can be converted into a dual-element full-range fuse by adding a series overload interrupter. The resulting fuse has a short-circuit interrupter as in FIG. I and an overload interrupter in one unit. As a low-cost alternative, an overload-interruption segment can be incorporated into link 14 of FIG. I. Such a fuse is shown in FIG. II.

The components in FIG. II are for the most part identical to those of FIG. I. Identical components in both Figures bear the same reference numerals; their description appears above. Modified components bear the same numerals that are primed. Thus fuse link 14 of FIG. I is link 14' in FIG. II, and an interruption segment 18' is incorporated in fuse element 14'.

Overload interruption segment 18' may take various forms, such as a low-melting alloy casting interposed between two otherwise disconnected portions **14*a* of the link. The alternative in FIG. II (as in the '106 patent) involves an M-effect overload interruption segment of the fuse element or, in fuses wherein the fuse link comprises multiple fuse elements in parallel, in each of the parallel fuse elements that comprise the fuse link. A low-melting alloy 18*a* (FIG. II) is applied near the necks of overload interruption segment 18'. During an extended delay interval, the overload current develops sufficient heating in the necks of segment 18' to melt alloy 18*a*. That alloy flows and becomes alloyed with an area of link 14'. The resistivity of that area of the link rises, and increased heating develops in that area. Ultimately the current is interrupted after the desired time delay. The M-effect element 18*a* only melts in response to the sustained heat developed by overload current in the necks of segment 18'**.

Details of suitable necks in the short-circuit interruption segments and suitable necks in the overload interruption segment of the fuse link are shown and described in U.S. Pat. No. 4,893,106, for example; those details are incorporated here by reference. It is to be understood that a modified fuse link can be made in various forms, as a one-strip fuse element or multiple parallel fuse elements or one or more cylindrical fuse elements as in the '106 patent.

The full-range fuse of FIG. II has the same filler as the fuse of FIG. I. The $B_2O_3$ is formed in situ by thermal decomposition of the boric acid in the sand. During that thermal treatment, some migration of the M-effect alloy **18*a* into the fuse element may occur, the extent of migration depending on many factors. This alloying of the M-effect metal could be excessive while the $B_2O_3$ is forming. With this in mind, appropriate alloys having higher-than-usual melting temperature may be chosen for element 18*a***, to be compatible with the heating step involved in producing the $B_2O_3$.

To advantage, the fuse of FIG. II is completed by introducing boric acid into the sand/$B_2O_3$ filler, for the purposes and in the manner set forth in U.S. Pat. No. 4,893,106. The description in that patent of how this is done is incorporated here by reference. The sand/$B_2O_3$ filler is a highly porous matrix, and is thus suitable for such introduction of boric acid.

The fuses of Figs. I and II ordinarily have silver fuse links. But as an alternative, the fuse links are of copper. Successful use of copper links in place of silver links is promoted by the high thermal conductivity of the novel filler. Where a strip of copper is used as a fuse link or where multiple copper strips in parallel constitute the fuse link, the thickness of each strip which forms a fusible element is reduced (compared with silver) because the resistance of the neck(s) must develop 29% more self-heating for copper than for silver in order to melt the copper neck.

It is apparent that the illustrative fuses of Figs. I and II and the methods used for producing them can be modified in many ways. Consequently, the invention should be construed broadly in accordance with its true spirit and scope.

I claim:

1. A fuse having a fuse link, terminals interconnected by the fuse link, an enclosure about said fuse link and a filler about said link in said enclosure, said filler comprising grains of sand having a shiny coating on the grains, the coating also bonding the grains together.

2. A fuse as in claim 1, wherein said sand is packed into said enclosure and wherein the material that is to form the coating is introduced into the packed sand and said shiny coating is formed in situ.

3. A fuse as in claim 1, wherein said shiny coating is essentially $B_2O_3$.

4. A fuse having a fuse link, terminals interconnected by the fuse link, an enclosure about said fuse link and a filler about said link in said enclosure, said filler comprising grains of sand having an amorphous coating on the grains that extends from grain to grain and bonds the grains of sand together.

5. A fuse as in claim 4, wherein the sand is packed in the enclosure about said link and wherein the material that is to form the coating is introduced into the packed sand and said coating is formed in situ.

6. A fuse as in claim 4, wherein said coating is essentially amorphous $B_2O_3$.

7. A fuse having a fuse link, terminals interconnected by the fuse link, an enclosure about said fuse link and a filler about said link in said enclosure, said filler comprising grains of sand having a binder comprising boric oxide unifying the grains of sand.

8. A fuse as in claim 7, wherein said boric oxide extends as a coating on the grains of sand and interconnects the grains of sand.

9. A fuse as in claim 7, wherein said boric oxide is formed on the grains of sand in situ by conversion from boric acid at a temperature high enough to produce amorphous boric oxide.

10. A fuse as in claim 7, wherein said filler results from the process of filling and packing the space about the fuse link with grains of sand and boric acid particles dispersed throughout the sand, and heating the fuse to a temperature sufficient to convert the boric acid to amorphous boric oxide.

11. A fuse as in claim 7, wherien the filler is provided by the process of filling and packing space about the fuse link in the enclosure with grains of sand, impregnating the sand with a solution of boric acid in water, extracting the water of solution so as to leave boric acid particles dispersed in the sand, and raising the temperature of the fuse to convert the boric acid to said amorphous boric oxide.

12. A fuse as in claim 9, wherien the grains of sand and particles of boric acid are separately charged with mutually opposite electrostatic polarities and are then combined, yielding grains of sand bearing boric acid particles, and wherien the space about the fuse link in the enclosure is then filled with said grains of sand bearing boric acid particles, and wherein the sand and boric acid are heated sufficiently to convert the boric acid to amorphous boric oxide.

13. The method of forming a hard insulating, arc-extinguishing filler about a fuse link in an enclosure of a fuse, including the steps providing a packed mass comprising grains of sand and particles of boric acid in the enclosure about the fuse link, and heating the fuse sufficiently to convert the boric acid to boric oxide.

14. The method as in claim 13, wherein the grains of sand are initially packed into the enclosure about the fuse link, the packed sand leaving voids between its grains, impregnating the sand with an aqueous solution containing boric acid in substantial concentration, extracting the water of solution and thereby leaving particles of boric acid distributed in the sand, and heating the fuse sufficiently to convert the boric acid into $B_2O_3$.

15. The method as in claim 14, wherien the boric acid solution is introduced into the sand at a temperature high enough to maintain the boric acid in solution in the water and wherein at least a large proportion of the water of solution is extracted by chilling the fuse and thereby separating water from the solution, and by evaporating the separated water.

16. The method as in claim 13, further including the steps of separately charging grains of sand and particles of boric acid with mutually opposite electrostatic polarities, forming a mixture of the charged grains of sand and particles of boric acid, thereby yielding grains of sand bearing particles of boric acid, and introducing said mixture into said enclosure to provide said packed mass.

17. A fuse as in claim 1, wherein said filler of grains of sand having said coating on said grains is porous and contains boric acid.

18. A fuse as in claim 4, wherien said filler of grains of sand having said coating on said grains is porous and contains boric acid.

19. A fuse as in claim 7, wherein said filler of grains of sand unified by said binder is porous and contains boric acid.

20. A fuse as in claim 7, wherein said boric oxide is formed as an amorphous coating on the grains of sand in situ by conversion from boric acid at a temperature appreciably above about 194° C.

* * * * *